US005979047A

United States Patent [19]

Gib

[11] Patent Number: 5,979,047

[45] Date of Patent: Nov. 9, 1999

[54] ELECTRICAL PLUG CONNECTOR WITH A LOCKING DEVICE

[75] Inventor: Michael Gib, Landau, Germany

[73] Assignee: Siemens Aktiengesellschaft, Munich, Germany

[21] Appl. No.: 08/946,715

[22] Filed: Oct. 8, 1997

Related U.S. Application Data

[62] Division of application No. 08/527,757, Sep. 13, 1995, abandoned.

[30] Foreign Application Priority Data

Sep. 13, 1994 [DE] Germany ..... 94 14 890 U

[51] Int. Cl.[6] ..... H01R 43/00

[52] U.S. Cl. ..... 29/883; 29/874; 29/882

[58] Field of Search ..... 29/876, 883, 874, 29/825, 828; 439/752

[56] References Cited

U.S. PATENT DOCUMENTS

| | | |
|---|---|---|
| 4,311,355 | 1/1982 | Plyler et al. . |
| 4,923,310 | 5/1990 | Sekiguchi et al. . |
| 4,962,285 | 10/1990 | Baker . |
| 5,035,648 | 7/1991 | Kuiper-Moore . |
| 5,066,252 | 11/1991 | Kato et al. . |
| 5,132,494 | 7/1992 | Burton et al. . |
| 5,299,958 | 4/1994 | Oshumi . |
| 5,362,261 | 11/1994 | Puerner . |
| 5,478,262 | 12/1995 | Yamanashi et al. . |

FOREIGN PATENT DOCUMENTS

| | | |
|---|---|---|
| 41 23 505 | 1/1993 | Germany . |
| 422 4155 | 2/1994 | Germany . |

*Primary Examiner*—Carl J. Arbes
*Attorney, Agent, or Firm*—Herbert L. Lerner; Laurence A. Greenberg

[57] ABSTRACT

An electrical plug connector includes a housing being formed of insulating material and having at least one contact chamber. A contact element is to be inserted in the at least one contact chamber in a given plugging direction. A locking device for the contact element is movable transversely to the given plugging direction, is formed of insulating material and is constructed as a slide. The locking device is transversely moveable between an initial detent position permitting the contact element to be inserted into the at least one contact chamber, and a final detent position locking the contact element. The housing and the locking device are formed from a thermoplastic synthetic having the same or different properties and are produced by multicomponent injection molding with the housing being injection molded directly on the slide.

8 Claims, 3 Drawing Sheets

ELECTRICAL PLUG CONNECTOR WITH A LOCKING DEVICE

This is a division of application Ser. No. 08/527,757 filed on Sep. 13, 1995 now abandoned.

BACKGROUND OF THE INVENTION

FIELD OF THE INVENTION

The present invention relates to an electrical plug connector, including a housing being formed of insulating material and having at least one contact chamber for an insertable contact element, and a locking device for the contact element being formed of insulating material, being constructed as a slide and being movable transversely to a plugging direction, wherein the locking device has a preliminary detent position in which the contact element can be introduced within the contact chamber, and the locking device is movable to a final detent position by transverse motion of the slide for locking of the contact element. Such plug connectors are already on the market.

The locking device of the known plug connector is used as a secondary securing device, while the primary securing device of the contact element that is introduced into the contact chamber is typically formed by detent tongues pointing away from the contact element. As plug connectors become increasingly more compact, the space for secondary securing devices also becomes tighter and tighter, and therefore there is no space left for most of the existing versions. It is predominantly for that reason that secondary securing devices constructed in the form of transverse slides have recently become increasingly important. In the known plug connectors, the housing and the locking device are constructed as separately produced individual parts, so that the slide must be introduced into the housing in its own, complicated assembly operation. In that assembly, which must be carried out by hand, care must be taken to ensure that the slide is introduced into the housing in the correct position and in such a way that it cannot fall out. The production of the individual parts not only requires a complicated assembly but also can impair the quality of the plug connector, because the tolerances add up, which is disadvantageous.

SUMMARY OF THE INVENTION

It is accordingly an object of the invention to provide an electrical plug connector with a locking device, which overcomes the hereinafore-mentioned disadvantages of the heretofore-known devices of this general type and which simplifies an assembly of a housing and the locking device to avoid tolerance problems and to reduce production costs.

With the foregoing and other objects in view there is provided, in accordance with the invention, an electrical plug connector, comprising a housing being formed of insulating material and having at least one contact chamber; a contact element to be inserted in the at least one contact chamber in a given plugging direction; and a locking device for the contact element being movable transversely to the given plugging direction, being formed of insulating material and being constructed as a slide; the locking device being transversely moveable between an initial detent position permitting the contact element to be inserted into the at least one contact chamber, and a final detent position locking the contact element; and the housing and the locking device being formed from a thermoplastic synthetic having the same or different properties and being produced by multi-component injection molding with the housing being injection molded directly on the slide.

In accordance with another feature of the invention, the slide forms the housing and is injection-coated by using at least one space-holding core causing a side of the slide to point in a sliding direction and border on the still empty at least one contact chamber.

In accordance with a further feature of the invention, the contact element has at least one detent tongue protruding in an arrow-like manner in the given plugging direction, and the slide has a side pointing in the given plugging direction and forming a detent edge for the detent tongue, to primarily secure the inserted contact element in every position of the slide.

In accordance with an added feature of the invention, the slide has an end pointing counter to the given plugging direction, and the slide has a laterally protruding securing element in the region of the end of the slide, for lockingly engaging a contour of the contact element from behind in the final detent position of the slide.

In accordance with a concomitant feature of the invention, the synthetics having different properties are polyoxymethylene (POM), for instance forming the slide, and polybutylene terephthalate (PBTP), for instance forming the housing.

Other features which are considered as characteristic for the invention are set forth in the appended claims.

Although the invention is illustrated and described herein as embodied in an electrical plug connector with a locking device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2A and 2B are simplified plan views of the same subconnector with contact chambers disposed in two rows, wherein FIG. 2A shows the preliminary or initial detent position and FIG. 2B shows a final detent position, of the locking device.

DESCRIPTION OF THE PREFERRED EMBODIMENTS

Figure 1:
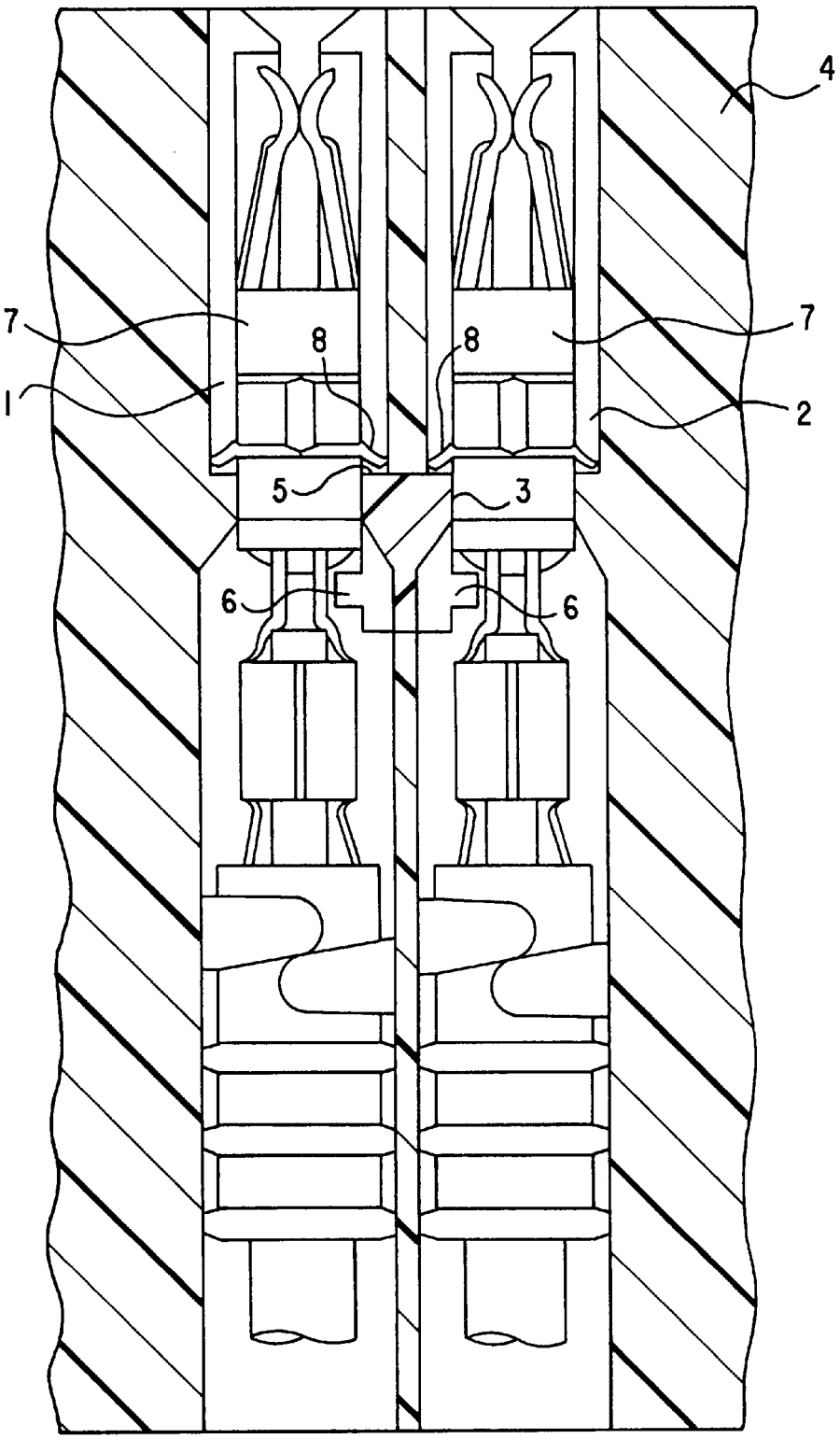
FIG. 1 is a simplified, fragmentary, diagrammatic, longitudinal-sectional side view of a plug connector housing with two assembled contact chambers being located by side with a slide between them, in a preliminary or predetent position.

Referring now to the figures of the drawing in detail and first, particularly, to FIG. 1 thereof, there are seen contact elements 7 which can each be inserted upward from below into a contact chamber 1, 2. If the contact elements 7 are not completely locked into place, that is evidenced clearly by the blocking of a secondary securing device, to be described in greater detail below. In cases where the contact still comes to rest quite far away from its intended final position, the secondary securing device does not block. In that case, the contact element 7 protrudes so far downward out of the contact chamber 1, 2 that the incorrect assembly is quite clearly apparent.

According to the invention, a slide 3 for forming a housing 4 can be injection-coated by using at least one space-holding core, in such a way that a side of the slide 3 pointing in a slide direction borders on the thus-far empty contact chamber 1, 2. In such a plug connector, the housing 4 and the locking device may be formed of thermoplastics having different properties. In the case of production by two-component injection molding, it is therefore possible to provide the housing 4 directly around the slide 3, thus dispensing with separate production and assembly processes for the individual parts and producing the plug connector in a single operation. The production of these two components according to the invention by two-component injection molding, is carried out in such a way that the slide 3 is first injected and then is injection-coated with the housing. In other words, the two components, the housing and locking device, are formed one after the other in one and the same injection tool. The slide 3 is placed in a hollow chamber that forms a holding nest, so that the housing 4 can be injected directly onto the slide 3 and thus mounted on the slide 3 directly in the injection mold by the injection process itself. Since the housing 4 with the slide 3 located in it can thus be removed while already being joined together as a single part, since it can form the injection tool and since it can be stored together, logistics and stockkeeping of these elements are made simpler. There are no longer any tolerance problems between the two components either, so that greater functional safety is attained. Another essential advantage is that incorrect assembly of the slide 3 which forms the locking device is precluded entirely, and a positionally correct disposition of the slide 3 in the housing 4 is assured by the joint production process.

However, it is also possible to use the same thermoplastic synthetic for the various components and to still produce the plug connector by multicomponent injection molding. The theoretical danger of resoftening of a component being injected beforehand can be counteracted by suitably adapting the injection parameters and injection cycle times, so that the various components can be molded in succession and injected onto one another without sticking of the components. The advantage of this structure is that the plug connector is made and assembled in a single injection process and is formed of one and the same synthetic. This improves not only the feasibility of manufacture but also the recyclability of the plug connector.

The height or top of the slide 3 can be constructed in various ways. For the sake of stability, it may be recommended that a detent edge 5 for primary securing of the contact elements be added to the slide 3. In that case, each contact element 7 has at least one detent tongue 8, protruding in an arrow-like manner away from it in the plugging direction. The side of the slide 3 pointing in the plugging direction forms the detent edge 5 for this detent tongue 8, in such a way that the inserted contact element 7 is primarily secured in every position of the slide. Since upon plugging the contact elements 7 are still unstressed and are inserted with play in the contact chambers 1, 2, displacement of the primary detent edge 5 below the detent tongues 8 is no problem.

Figure 2A:
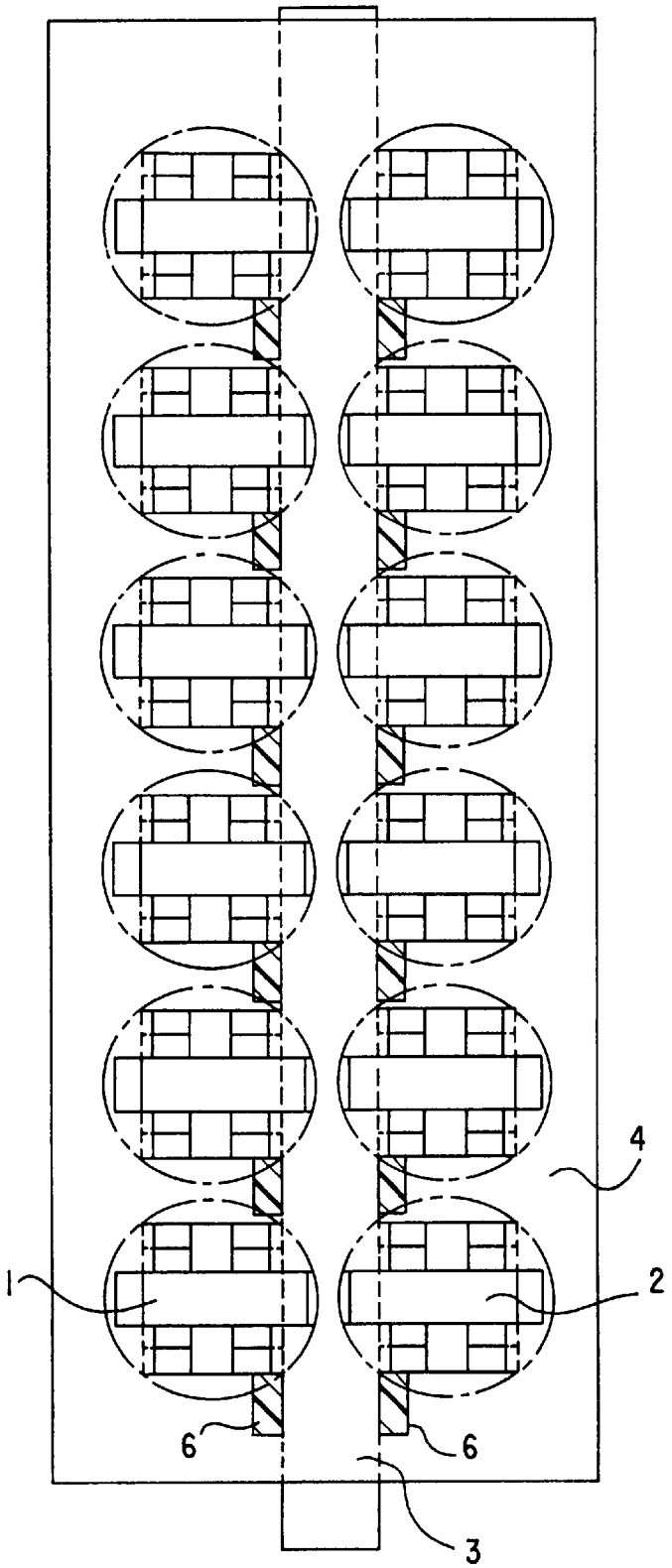
Figure 2B:
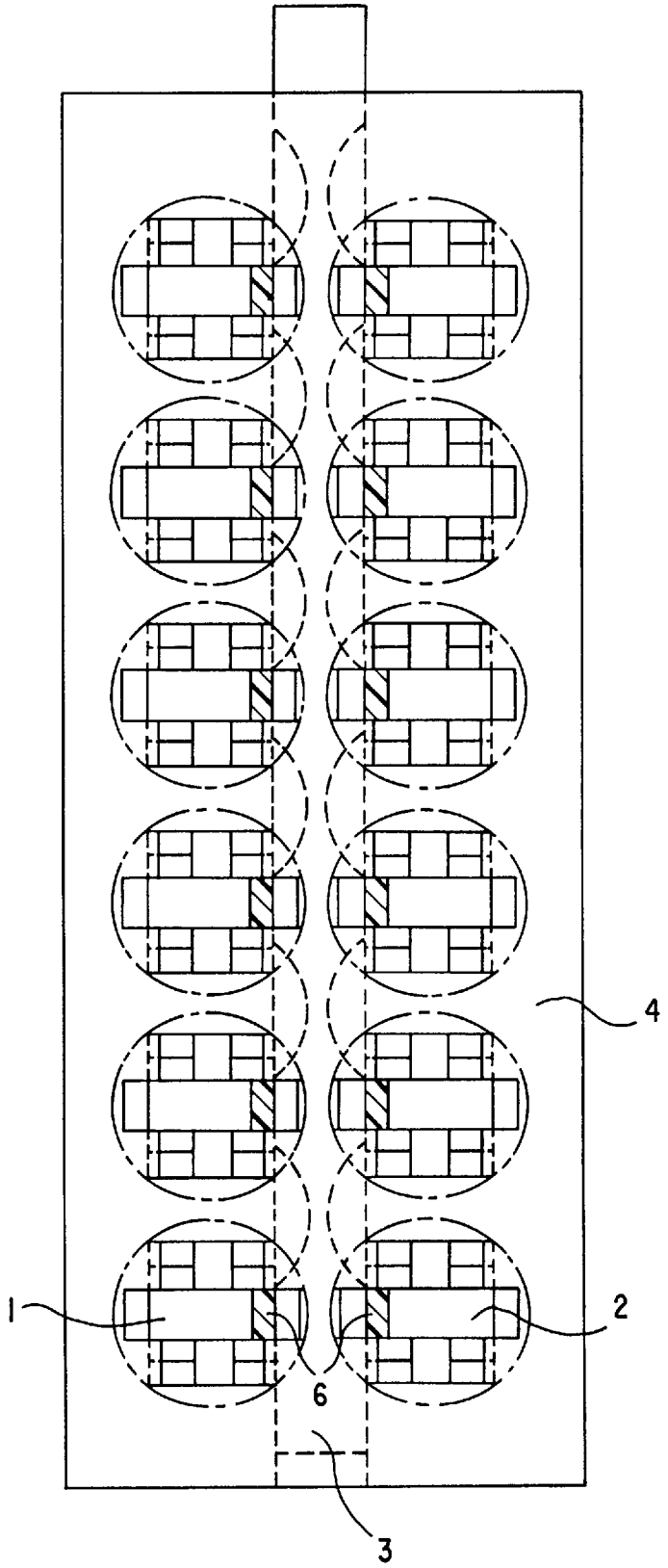

The actual secondary securing device of the locking device, which is shown in the initial, preliminary or predetent position in FIG. 1, comes about because a laterally protruding securing element 6 which is formed in the region of the end of the slide 3 pointing counter to the plugging direction, engages the contour of the contact element 7 lockingly from behind in the final detent position of the slide 3. This process is again clearly shown in FIGS. 2A and B, in which the securing elements 6 are shaded. If the contact element 7 has not been inserted far enough, the secondary securing element 6 strikes the contour of the contact element and blocks the slide 3. During disassembly, the contact element 7 cannot be removed because of the secondary securing element 6, until after the secondary securing element is released, or in other words pushed back into the predetent position. Thus, the contact elements which are removed later are also retained in a primary and a secondary manner with the same security as the contact elements which were mounted first.

I claim:

1. A method for producing an electrical plug connector, which comprises:

injection molding a locking device constructed as a slide and made from a thermoplastic synthetic insulating material;

thereafter injection molding a housing having at least one contact chamber around and partially enclosing the slide and made from a thermoplastic synthetic insulating material;

forming a contact element and inserting the contact element in the at least one contact chamber in a plugging direction for releasably locking to the locking device formed as the slide, and the slide being movable transversely to the plugging direction, the locking device being transversely moveable between an initial detent position permitting the contact element to be inserted into the at least one contact chamber and a final detent position locking the contact element to the locking device; and moving the locking device to the final detent position locking the contact element in place.

2. The method according to claim 1, which comprises injection molding the housing with the thermoplastic synthetic having the same properties as the thermoplastic synthetic used to form the locking device.

3. The method according to claim 1, which comprises injection molding the housing with the thermoplastic synthetic having different properties from the thermoplastic synthetic used to form the locking device.

4. The method according to claim 1, which comprises forming the slide by injection-coating using at least one space-holding core causing a side of the slide that points in a sliding direction to border on the at least one contact chamber.

5. The method according to claim 1, which further comprises forming the contact element with at least one detent tongue protruding in an arrow-like manner in the plugging direction, and forming the slide with a side pointing in the plugging direction forming a detent edge for the detent tongue to primarily secure the inserted contact element in the slide.

6. The method according to claim 1, which further comprises injection molding the slide with an end pointing counter to the plugging direction, and forming the slide with a laterally protruding securing element in a region of the end of the slide for lockingly engaging a contour of the contact element from behind in the final detent position of the slide.

7. The method according to claim 3, which comprises injection molding thermoplastic synthetics having different properties and the thermoplastic synthetics being polyoxymethylene (POM) and polybutylene terephthalate (PBTP).

8. The method according to claim 3, which comprises injection molding thermoplastic synthetics having different properties and the thermoplastics being polyoxymethylene (POM) for forming the slide and polybutylene terephthalate (PBTP) for forming the housing.

* * * * *